US007319187B2

(12) United States Patent
Sunako

(10) Patent No.: US 7,319,187 B2
(45) Date of Patent: Jan. 15, 2008

(54) TONE GENERATION CONTROL PROGRAM AND ELECTRONIC KEYBOARD INSTRUMENT USING THE TONE GENERATION CONTROL PROGRAM

(75) Inventor: Motonori Sunako, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 535 days.

(21) Appl. No.: 10/898,644

(22) Filed: Jul. 23, 2004

(65) Prior Publication Data

US 2005/0016369 A1 Jan. 27, 2005

(30) Foreign Application Priority Data

Jul. 25, 2003 (JP) ..... 2003-201694

(51) Int. Cl.
*G10H 1/02* (2006.01)
*G10H 5/00* (2006.01)

(52) U.S. Cl. ..... 84/662; 84/737

(58) Field of Classification Search ..... 84/737, 84/626, 662, 701
See application file for complete search history.

(56) References Cited

U.S. PATENT DOCUMENTS 4,416,178 A 11/1983 Ishida
5,453,571 A 9/1995 Adachi et al.
6,365,820 B1 4/2002 Kondo et al.
2003/0131720 A1 7/2003 Sakurada et al.

*Primary Examiner*—Jeffrey Donels
(74) *Attorney, Agent, or Firm*—Morrison & Foerster LLP

(57) ABSTRACT

There is provided a procedure for generating tone-generation controlling key-on and key-off signals, which is applicable to either a first-type key operation detection device that, in response to depressing operation of a key, generates detection signals in correspondence with at least predetermined upper and lower positions or a second-type key operation detection device that, in response to depressing operation of a key, not only generates detection signals in correspondence with at least predetermined upper and lower positions but also generates a detection signal of an intermediate position unobtainable by the first-type key operation detection device. On the basis of the detection signals received from the key operation detection device applied, a first key-on signal is generated when a key has reached the lower position from the upper position. Further, on the basis of the detection signals, a determination is made as to whether or not particular operation has been performed for causing the key to reach the lower position from the intermediate position after generation of the first key-on signal but before generation of a key-off signal, and, if so, a second key-on signal is generated. Furthermore, on the basis of the received detection signals, a key-off signal is generated in correspondence with the generated first or second key-on signal when the key has returned to a predetermined key-off position after generation of the first or second key-on signal.

7 Claims, 4 Drawing Sheets

TONE GENERATION CONTROL PROGRAM AND ELECTRONIC KEYBOARD INSTRUMENT USING THE TONE GENERATION CONTROL PROGRAM

BACKGROUND OF THE INVENTION

The present invention relates to tone generation control programs for performing tone generating signal control in response to operation of keyboards to cause electronic keyboard instruments to electronically generate tones, and electronic keyboard instruments using such tone generation control programs. Particularly, the present invention concerns an improved tone generation control program which can be suitably applied to various types of electronic keyboard instruments, having different numbers of sensors provided at predetermined positions along the key strokes of individual keys for detecting depression of the keys, for performing tone generating signal control to allow each of the electronic keyboard instruments to accurately generate tones, and an electronic keyboard instrument using the improved tone generation control program. The present invention also relates to an electronic keyboard instrument using the tone generation program and a method for generating tone-generation controlling key-on and key-off signals according to a procedure corresponding to the tone generation program.

From U.S. Pat. No. 6,365,820, etc., there have been known electronic keyboard instruments which are constructed in imitation of natural keyboard-type musical instruments and electronically generate tones in response to player's operation on the keyboard. Namely, such electronic keyboard instruments, each including a keyboard to be operated by a human player as in natural musical instruments, generate tones in accordance with tones pitches and tone generation timing determined by player's operation on the keyboard. There haven been known two major schemes for detecting depressed states of the individual keys in the electronic keyboard instruments. The first scheme uses a first-type key operation detection device for generating detection signals of a plurality of positions, in response to depression of a key, via key-depression detecting sensors etc. provided at two predetermined points along the key stroke of each key; for convenience; this scheme will be referred to as a "two-make touch response switch scheme". The second scheme uses a second-type key operation detection device for generating detection signals of a plurality of positions different from those in the first-type key operation detection device, in response to depression of a key, via key-depression detecting sensors etc. provided at three predetermined points along the key stroke of each key; for convenience, this scheme will be referred to as a "three-make touch response switch scheme".

The above-mentioned two-make touch response switch scheme and three-make touch response switch scheme will be explained briefly with reference to FIG. 5. FIG. 5 is an enlarged fragmentary view schematically showing construction of keyboards in electronic keyboard instruments; namely, construction of keyboards in two electronic keyboard instruments employing the two-make touch response switch scheme (hereinafter also called "two-make construction") and three-make touch response switch scheme (hereinafter also called "three-make construction"), respectively, are illustrated in the same figure to facilitate comparison between the two schemes. Keyboard 1 includes a plurality of white keys and a plurality of black keys; however, the construction will be explained here in relation to one of the white keys depicted at 11 in FIG. 5. Note that the other keys (other white and black keys) are constructed similarly to the key 11. The key 11 is pivotable downward by downward depressing operation depicted by a black arrow (representing the "depressing direction") in the figure. For each of the keys, a sensor located at a predetermined highest depression position of the key will be referred to as an "a" sensor, a sensor located at a predetermined intermediate position will be referred to as a "b" sensor, and a sensor located at a predetermined lowest position will be referred to as a "c" sensor.

As will be understood from FIG. 5, the electronic keyboard instrument based on the two-make touch response switch scheme includes sensors placed at two, highest and lowest, depression positions corresponding to initial and full depression of the key (i.e., "a" and "c" sensors). Contact switches of the individual sensors placed in this manner are turned on/off in response to pivotal movement of the key 11, so that a current depressed state of the key 11 can be detected by the sensors. Then, a start and stop of audible generation (i.e., start of sounding and silencing or deadening) of a tone at a pitch assigned to that key 11 is controlled in accordance with the depressed state of the key 11 detected by the sensors. In addition to such control of the audible generation of the tone, velocity control of the tone may be performed by identifying a velocity of the depressing operation of the key 11 on the basis of a difference between times of detection by the two contact switches.

The three-make touch response switch scheme, which may be called an improvement over the two-make touch response switch scheme, includes sensors placed not only at the highest and lowest depression positions corresponding to the initial and full depression of the key but also at a predetermined intermediate position between the highest and lowest depression positions; namely, the electronic keyboard instrument based on the three-make touch response switch scheme includes the "b" sensor in addition to the "a" and "c" sensors. With the three-make touch response switch scheme that permits finer detection of the pivotal movement of the key 11 than the two-make touch response switch scheme, the human player can instruct re-generation of the tone by just returning the key 11 to the intermediate point without completely returning the key 11 to the initial depression position; in this way, it is possible to enhance the capability of the instrument to generate successive tones of a same note in response to successive depressing operation of the same key. Further, because the three-make touch response switch scheme permits more accurate detection of the depressing velocity of the key 11, finer velocity control can be performed.

Of the sensors shown in FIG. 5, the "b" sensor and "c" sensor can only detect when the key 11 has moved from a shallow depression position to a deep depression position. The "a" sensor, on the other hand, can not only detect when the key 11 has moved from the shallow depression position to the deep depression position but also detect when the key 11 has moved from the deep depression position back to the shallow depression position in response to key-releasing operation by the human player.

Generally, keyboards of electronic keyboard instruments are constructed on the basis of either the two-make touch response switch scheme or the three-make touch response switch scheme. In order to perform tone generating signal control in accordance with the keyboard construction actually employed (i.e., two- or three-make touch response switch scheme), it has been necessary to prepare in advance respective dedicated tone generation control programs for the two- and three-make touch response switch schemes and previously install a suitable one of the dedicated tone generation control programs in accordance with the actual construction of the keyboard. However, developing the separate tone generation control programs for the two- and three-make touch response switch schemes would significantly add to development cost. Further, any necessary change, addition, correction or the like has to be made separately to each of the tone generation control programs for the two touch response switch schemes, which would require extra time and labor. Furthermore, a sophisticated electronic keyboard instrument has recently been known, which has a structure to allow its component parts to be upgraded at any desired time, for example, after purchase of the instrument. When the keyboard in such a sophisticated electronic keyboard instrument is upgraded from the two-make touch response switch scheme to the three-make touch response switch scheme, there would arise a need to replace the tone generation control program for the two-make touch response switch scheme with the tone generation control program for the three-make touch response switch scheme (namely, reinstall the tone generation control program). Such program replacing operations would be very cumbersome, or the replacement of the tone generation control program itself tends to be completely forgotten.

SUMMARY OF THE INVENTION

In view of the foregoing, it is an object of the present invention to provide an improved tone generation control program which is compatible with and suitably applicable to both an electronic keyboard instrument having a keyboard based on the two-make touch response switch scheme (i.e., the first-type key operation detection device) and an electronic keyboard instrument having a keyboard based on the three-make touch response switch scheme (i.e., the second-type key operation detection device). It is another object of the present invention to provide an electronic keyboard instrument using the tone generation program. It is further object of the present invention to provide a method for generating tone-generation controlling key-on and key-off signals according to a procedure corresponding to the tone generation program.

According to an aspect of the present invention, there is provided a program for causing a processor to perform a procedure for generating tone-generation controlling key-on and key-off signals on the basis of detection signals supplied by a key operation detection device, wherein there can be applied, as the key operation detection device, either a first-type key operation detection device that, in response to depressing operation of a key, generates detection signals in correspondence with at least predetermined upper and lower positions or a second-type key operation detection device that, in response to depressing operation of a key, not only generates detection signals in correspondence with at least predetermined upper and lower positions but also generates a detection signal of an intermediate position unobtainable by the first-type key operation detection device. The procedure comprises: a first step of receiving the detection signals from the key operation detection device applied; a second step of, on the basis of the received detection signals, generating a first key-on signal when a key has reached the lower position from the upper position; a third step of, on the basis of the received detection signals, determining whether or not particular operation has been performed for causing the key to reach the lower position from the intermediate position after generation of the first key-on signal but before generation of a key-off signal, and generating a second key-on signal if it is determined that the particular operation has been performed; and a fourth step of, on the basis of the received detection signals, generating a key-off signal in correspondence with the generated first or second key-on signal when the key has returned to a predetermined key-off position after generation of the first or second key-on signal.

According to the present invention, the same program can be applied to either the first-type key operation detection device or the second-type key operation detection device. In the case where the first-type key operation detection device is applied, the detection signal of the intermediate position is not generated, and thus the second key-on signal is not generated by the third step. In the case where the second-type key operation detection device is applied, on the other hand, a predetermined determination condition is satisfied when a key, having been first depressed to from the upper position to the lower position, is returned to the intermediate position and then again depressed to reach the lower position from the intermediate position. Therefore, in the case where the first-type key operation detection device is applied, successive operation (striking) of a same key can be achieved by a human player repeating depression of the key from the upper position to the lower position to thereby cause repeated generation of the first key-on signal. In the case where the second-type key operation detection device is applied, on the other hand, successive operation (striking) of a same key can be achieved by the human player first depressing the key from the upper position to the lower position to thereby cause generation of one first key-on signal and then repeating depression of the key from the intermediate position to the lower position to thereby cause repeated generation of the second key-on signal. Thus, irrespective of which of the first- and second-type key operation detection devices is employed, the present invention can always appropriately identify successive operation (striking) of a same key in a manner suited to the key operation detecting performance of the key operation detection device employed, with the result that it permits generation of tones responsive to successive operation of a same key or note.

The present invention may be constructed and implemented not only as the program executable by a processor, such as a computer or DSP, as discussed above, but also as a storage medium storing such a program. Also, the present invention may be arranged and implemented as an apparatus invention or a method invention. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

Figure 1:
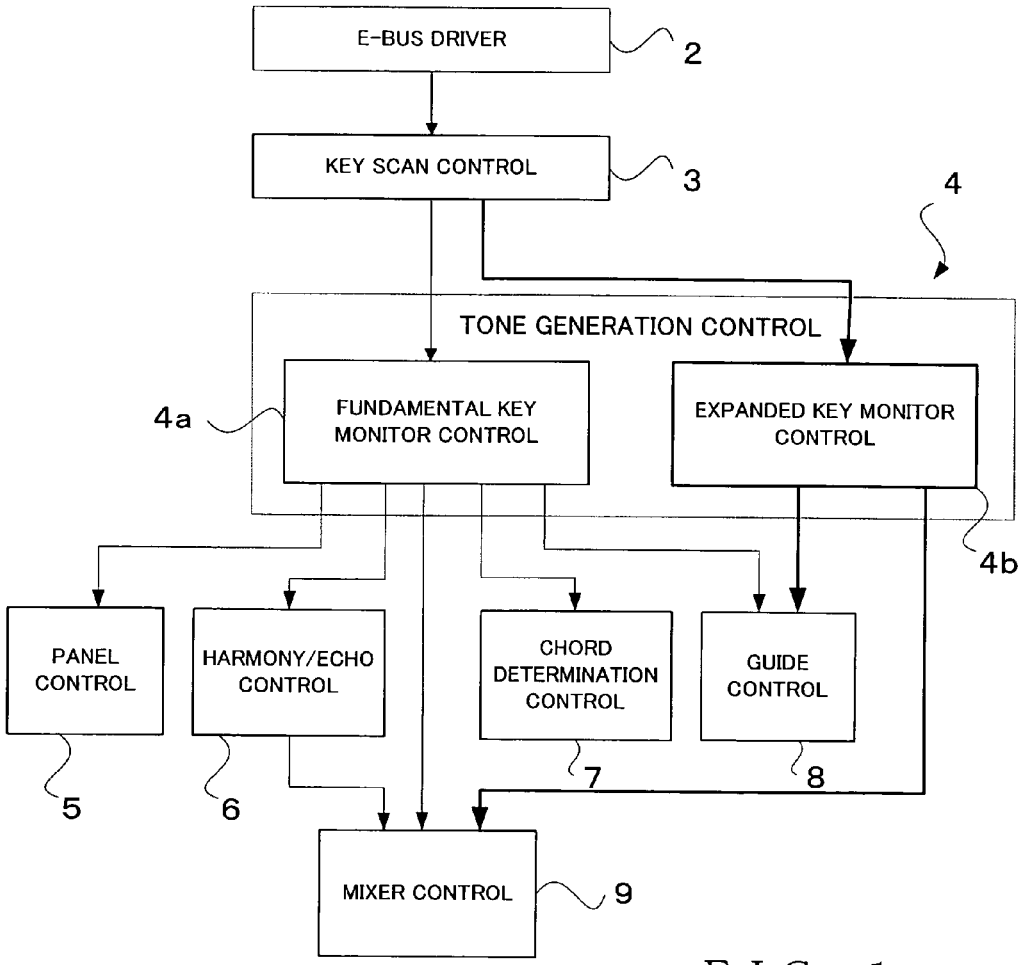
FIG. 1 is a block diagram showing an example general hardware setup of an electronic keyboard instrument in accordance with an embodiment of the present invention.

FIG. 1 is a functional block diagram showing example control functions performed by an electronic keyboard instrument in accordance with an embodiment of the present invention. In the instant embodiment, the functions are performed by various software programs executed under control of a microcomputer (not shown) which includes a microprocessor unit (CPU), a read-only memory (ROM) and a random-access memory (RAM). Of course, these functions may be performed by other means than the computer software, such as microprograms executed by a DSP (Digital Signal Processor). Alternatively, the functions may be performed by a dedicated hardware device including discrete circuits, integrated circuitry, large-scale integrated circuitry or the like. For convenience of understanding, key-on/key-off signals generated by a tone generation control section 3 in accordance with key depression states will be described as classified into fundamental key-on/key-off signals and expanded key-on/key-off signals. However, in a mixer control section 9 and other control sections, both the fundamental key-on/key-off signals and the expanded key-on/key-off signals are used as similar key-on/key-off signals with no distinction, and various control, such as control for sounding/deadening (or silencing) of tones at pitches corresponding to extracted keys, is carried out in accordance with the key-on/key-off signals.

Key scan control section 3 receives operation information per key via an E-bus driver section 2 and carries out a search process for sequentially extracting depression-operated keys from among a plurality of keys. The E-bus driver section 2 is an interface driver that, in response to key operation by a human player, allows operation information, detected via sensors provided in corresponding relation to the keys, to be transmitted to the CPU, DSP or the like carrying out various control processes. As keys of the electronic keyboard instrument are depressed by the human player, operation information corresponding to movement (depressed positions) of the individual keys is generated via a plurality of sensor switches (FIG. 5) located at predetermined depression positions of the keys, as will be later detailed. On the basis of the operation information received via the E-bus driver section 2, the key scan control section 3 extracts the keys corresponding to the operation information, as keys on which tone generation control is to be performed in accordance with the operation. Tone generation control section 4 interprets the operation information output from the individual sensors of the extracted keys, to thereby generate and output key-on and key-off signals; that is, the tone generation control section 4 performs tone generation control in accordance with the depressed positions of the keys. Also, velocity values can be calculated from the operation information output from the sensors.

The tone generation control section 4 performing such processes generally comprises a fundamental key monitor control section 4*a* and an expanded key monitor control section 4*b*. The fundamental key monitor control section 4*a* is provided for performing a key monitor process concerning operation of keys of the conventionally-known two-make construction, which is carried out only in relation to generation of the fundamental key-on/key-off signals. Here, the terms "fundamental key-on/key-off signals" represent a pair of a key-on signal generated on a keyboard when a key has been operated in a complete non-operated state and a key-off signal generated when an operated key has been completely released. The expanded key monitor control section 4*b* is, on the other hand, provided for performing a key monitor process concerning operation of keys of the three-make construction, which is carried out only in relation to generation of the expanded key-on/key-off signals other than the above-mentioned fundamental key-on/key-off signals. Namely, when, in an electronic keyboard instrument of the three-make construction, a key has been first depressed to an on-the-way (intermediate) position after generation of a fundamental key-on signal and then depressed further, a plurality of key-on signals are generated in accordance with the number of key depressions effected (for example, one key-on signal is generated each time any one of sensors provided for the key detects the depression); hereinafter, such key-on signals will be referred to as expanded key-on signals to distinguish from the above-mentioned fundamental key-on signals. Further, when the key has been released completely after operation, key-off signals corresponding in number to the generated expanded key-on signals are generated along with the above-mentioned fundamental key-off signals; hereinafter, such key-off signals will be referred to as expanded key-off signals to distinguish from the above-mentioned fundamental key-off signals. Namely, in the instant embodiment, the expanded key-on/key-off signals are key-on/key-off signals other than the fundamental key-on/key-off signals.

The fundamental key-on/key-off signals and expanded key-on/key-off signals generated by the tone generation section 4 are delivered to a panel control section 5, harmony/echo control section 6, chord determination control section 7, guide control section 8 and mixer control section 9, each of which carries out various processes in accordance with the received key-on/key-off signals. For example, the panel control section 5 carries out various display processes, such as one for indicating, in accordance with the key-on signals, notes on a musical score display on a display device in the form of a liquid crystal display (LCD) panel or CRT (Cathode Ray Tube). The harmony/echo control section 6 imparts musical characteristics, such as those of a harmony or echo, to tones generated in accordance with the key-on signals. The chord determination control section 7 determines a type of a chord on the basis of pitches of tones generated in accordance with a plurality of the key-on signals. The guide control section 8 performs illumination/deillumination control of light emitting elements, provided at predetermined locations of the keyboard, in accordance with the key-on/key-off signals. The light emitting elements, which may be in the form of LEDs, are intended to provide a performance guide for indicating keys operated by the human operator. The mixer control section 9 receives performance information, such as key-on/key-off signals generated in response to user's (human player's) operation on the keyboard, and generates tones on the basis of the received performance information. Namely, the mixer control section 9 causes a tone generator to generate a tone signal, in accordance with key-on/key-off signals and velocity value generated in response to operation of a key, such that the tone signal assumes a tone pitch and color predefined on a predetermined table or the like in correspondence with that key, and causes the generated tone signal to be audibly reproduced or sounded through a speaker after being converted into an analog signal and amplified via an amplifier.

As noted above, either the fundamental key monitor control section 4*a* or the expanded key monitor control section 4*b* is used selectively in the tone generation control section 4 in accordance with an operated state of a key, to generate a fundamental key-on/key-off signal or expanded key-on/key-off signal. Therefore, a description will now be made about tone generation control processing, with reference to FIG. 2 that is a flow chart showing an example of the tone generation control processing. The tone generation control processing of FIG. 2, which is based on a common tone generation control program applicable to both electronic keyboard instruments of the two-make touch response switch scheme and three-make touch response switch scheme, detects how individual keys of the keyboard have been varied by user's human player's) operation and performs control as to how each detected key variation should be reflected as a key-on/key-off signal. Here, the tone generation control processing sequentially carries out the following operations for individual keys extracted via the key-scan control section 3 of FIG. 1.

Figure 5:
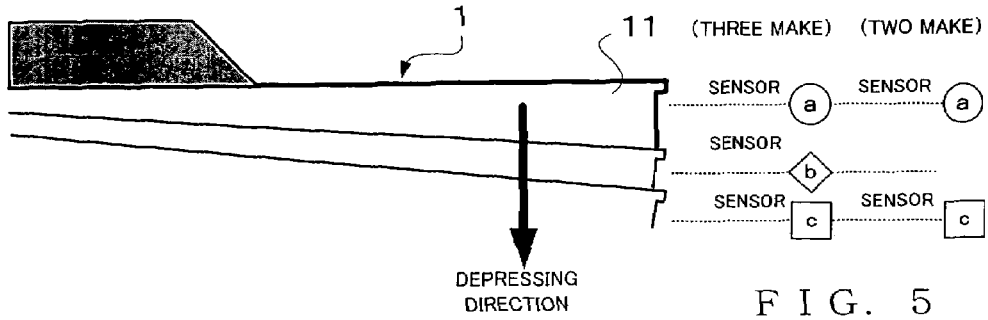
FIG. 5 is an enlarged fragmentary view of a keyboard in an electronic keyboard instrument.

At steps S1, S4 and S6, a determination is made, for each of the keys detected by the key-scan control section 3, as to which of the plurality of sensors, provided at the predetermined positions of the detected key (for convenience of the following description, the sensor located at a highest position of the key will be referred to as a "a" sensor, the sensor located at an intermediate position a "b" sensor, and the sensor located at a lowest position a "c" sensor, as illustrated in FIG. 5), has (or have) been turned on to generate a detection signal. If the detection (detection signal generation) of the key is due to turning-on of the highest "a" sensor (YES determination at step S1), a damper is turned on at step S2, and timer counting is started at step S3. Namely, once an output from the "a" sensor, representing initial depression of the key is detected, not only the damper is turned on, but also time measurement based on the timer counting is initiated. The time measured by the timer counting is used to ultimately determine or set a velocity value representative of an intensity or velocity with which the key has been struck or depressed. If the detection (detection signal generation) of the key is due to turning-on of the intermediate "b" sensor (YES determination at step S4), the time measurement by the timer counting is started all over again at step S5. Namely, once an output from the intermediate "b" sensor, located on the way through a depression stroke of the key, is detected, the already-initiated time measurement by the timer counting is initialized, e.g. reset to "0", on the assumption that the key has been depressed to an intermediate point of the depression stroke, and then the time measurement is resumed. Thus, in the case of the three-make construction, a velocity value can be determined in accordance with a time within which the key passes between the intermediate "b" sensor and the lowest "c" sensor. In the case of the two-make construction, such operations of steps S4 and S5 are not performed because the intermediate "b" sensor is not provided. Namely, the operations of steps S2 and S4 performed when the "a" sensor has been turned on are necessary for detecting a key operating velocity to determine a velocity value in the two-make construction, while the operations of steps S4 and S5 performed when the "b" sensor has been turned on are necessary for detecting a key operating velocity to determine a velocity value in the three-make construction.

If the detection (detection signal generation) of the key is due to turning-on of the lowest "c" sensor, not the "a" or "b" sensor (YES determination at step S6), a determination is made at step S7 as to whether there has already been generated a key-on event for the key, more specifically a fundamental key-on signal for the key. If no key-on signal has been generated yet for the key (NO determination at step S7), the time measurement by the timer counting is ceased temporarily and then the timer count is initialized, e.g. reset to "0", at step S8. After that, a fundamental key-on signal is generated at step S9. After step S9 or in response to a YES determination at step S7, the processing proceeds to step S12. Namely, when the output of the "c" sensor, indicating that the key has been depressed to the lowest (deepest) position, has been detected, and if the key is not yet in the key-on state, a fundamental key-on signal is generated to set the key in the key-on state. The reason why no further fundamental key-on signal is generated if the key is already in the key-on state is to prevent a tone of a pitch associated with that key from continuing to sound even after release of the key due to a discrepancy between key-on signals and key-off signals that should be output in one-to-one correspondence with the key-on signals, as will be later described in greater details. Further, once the "c" sensor is turned on, the time measurement by the timer counting, forming a velocity-determining basis, is ceased so as to determine a timer count value. The thus-determined timer count value is sent to a mixer processing section 9 (FIG. 1) etc. so that it can be used for velocity control.

If none of the "a", "b" and "c" sensors has been turned on as determined at steps S1, S4 and S6 (NO determination at each of steps S1, S4 and S6), then a further determination is made at step S10 as to whether the detection (detection signal generation) of the key is due to turning-off of the "a" sensor. If the detection (detection signal generation) of the key is due to turning-off of the "a" sensor (YES determination at step S10), a fundamental key-off signal is generated at step S11, and then the processing proceeds to step S12. At step S12, an expanded key monitor process is carried out, which is a process for generating key-on/key-off signals other than fundamental key-on/key-off signals, i.e. generating expanded key-on/key-off signals. Namely, the expanded key monitor process is a process dedicated to electronic keyboard instruments of the three-make construction; that is, the expanded key monitor process is not performed in electronic keyboard instruments of the two-make construction. Details of the expanded key monitor process will be given later in relation to FIG. 3. At step S13, a next key is selected, and the tone generation control processing reverts to step S1 in order to carry out the above-described operations for the next key. In the manner described above, the operations of steps S6-S12 control a start of audible generation (i.e., sounding) of a tone and an end of audible generation of a tone (i.e., deadening or silencing of the tone).

Figure 2:
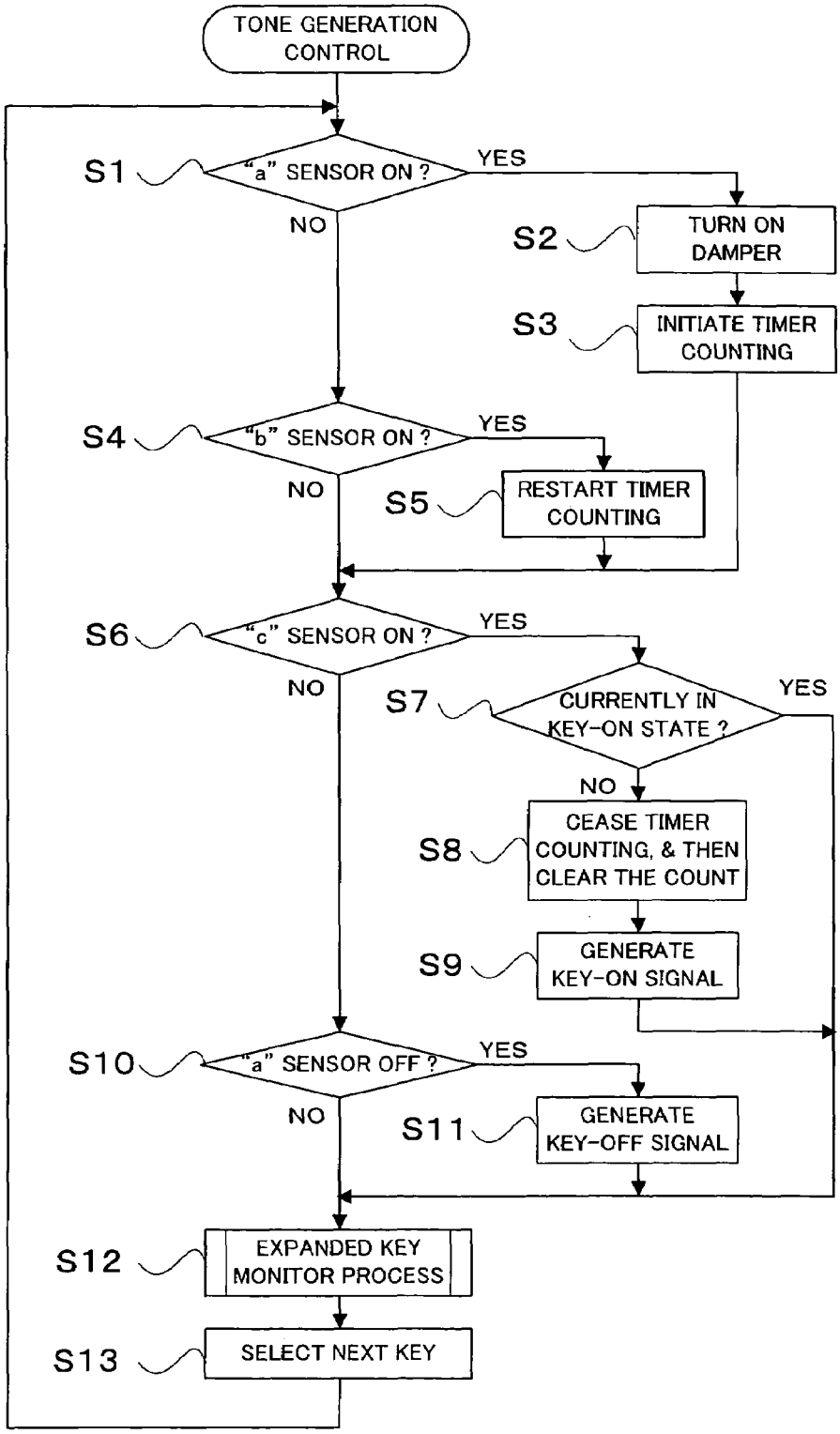
FIG. 2 is a flow chart showing an example of tone generation control processing performed in the embodiment.
Figure 3:
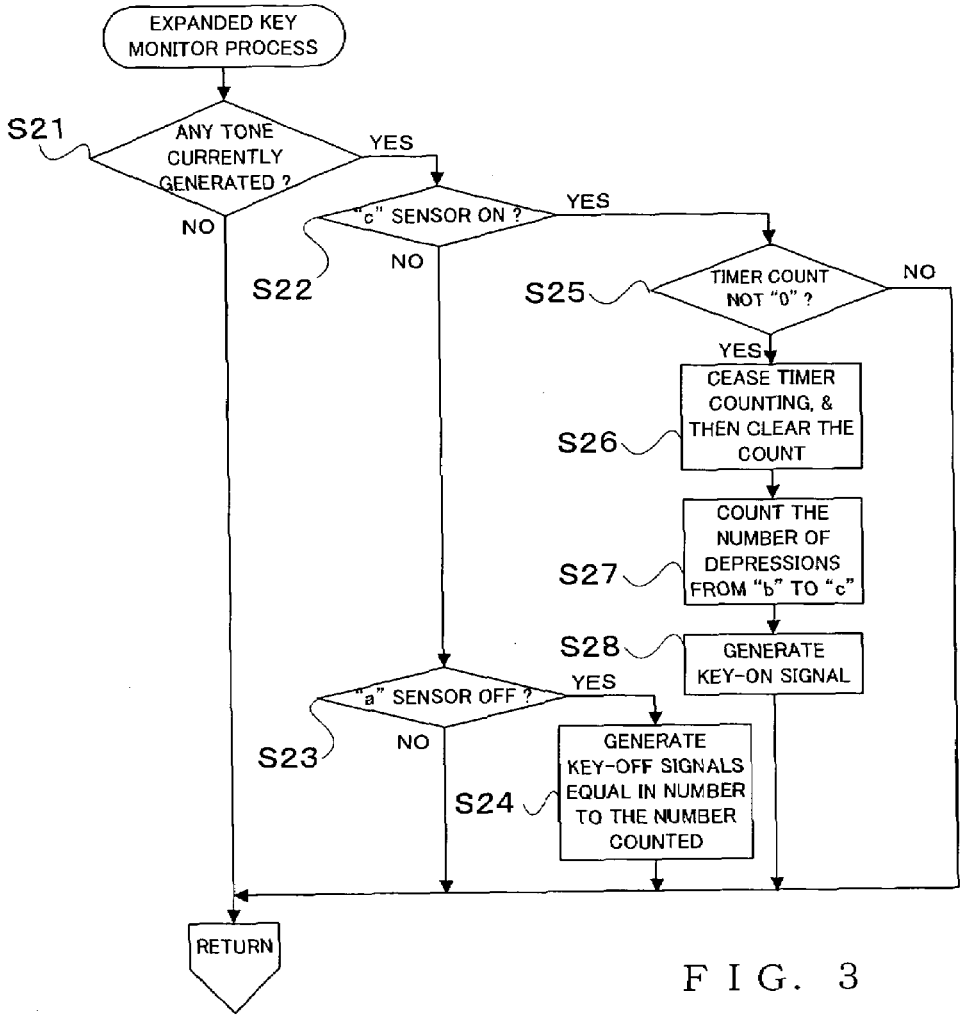
FIG. 3 is a flow chart showing an expanded key monitor process performed in the embodiment.

The following paragraphs describe the "expanded key monitor process" carried out in the tone generation control processing (step S5 of FIG. 2). FIG. 3 is a flow chart showing an example operational sequence of the expanded key monitor process.

At step S21, it is determined whether any tone is being currently audibly generated, i.e. whether any key is currently in the key-on state due to operation of the key on the electronic keyboard instrument. If no tone is being currently generated (NO determination at step S21), the expanded key monitor process is brought to an end. If, on the other hand, any tone is being currently generated (YES determination at step S21), a determination is made at step S22 as to whether the "c" sensor of the key has been newly turned on. If answered in the affirmative (YES determination at step S22), a further determination is made at step S25 as to whether the current timer count is not "0". If the current timer count is "0" (NO determination at step S25), it means that the once-depressed key has been further depressed to the lowest position ("c" sensor position) before being returned to the intermediate position ("b" sensor position). Therefore, in this case, the expanded key monitor process is brought to an end without performing steps S26-S28. If the current timer count is not "0" (YES determination at step S25), the time measurement by the timer counting is ceased to thereby fix the timer count value and then the timer count is initialized, e.g. reset to "0", at step S26. Namely, if the timer counting has progressed, i.e. if the time measurement is currently in progress, it means that the human operator has performed operation to return the key, and thus the timer count value fixed by ceasing the timer counting as noted above is used as a velocity of a tone to be newly generated. The fixed timer count value is cleared after the use so as to prepare for time measurement responsive to next operation. The number of depressions of the key from the "b" sensor position to the "c" sensor position is counted at step S27, and a further (i.e., expanded) key-on signal is generated for the key at step S28. Namely, each expanded key-on signal is counted. The count may be incremented each time the operation of step S27 is carried out.

If the "c" sensor of the key has not been turned on as determined at step S22 (NO determination at step S22), a further determination is made at step S23 as to whether the "a" sensor of the key has been turned off. With a YES determination at step S23, one or more key-off (expanded key-off) signals equal in number to the number counted at step S27 are generated at step S24.

Figure 4A:
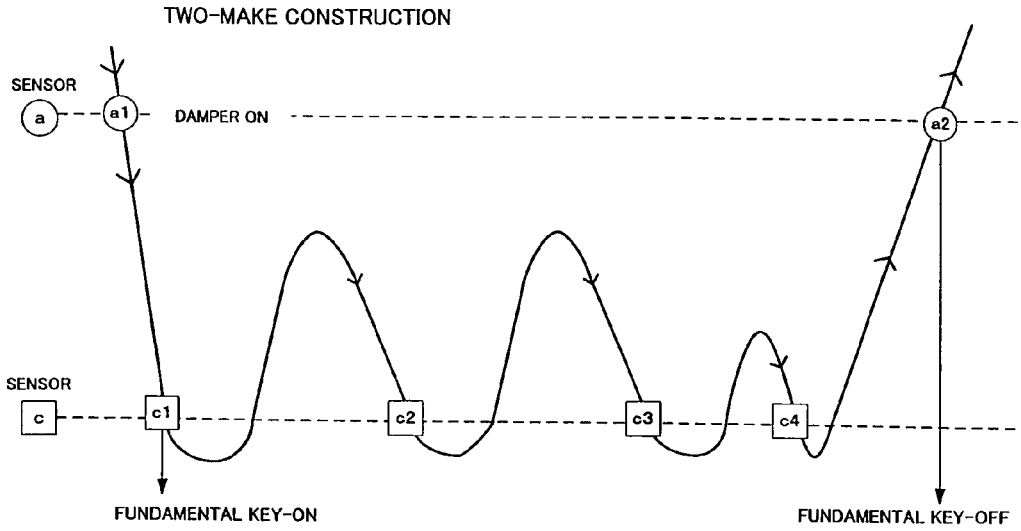
FIGS. 4A and 4B are diagrams conceptually showing relationship between variation over time in depressed position of a key and generated signals in an electronic keyboard instrument of the two-make construction and in an electronic keyboard instrument of the three-make construction.
Figure 4B:
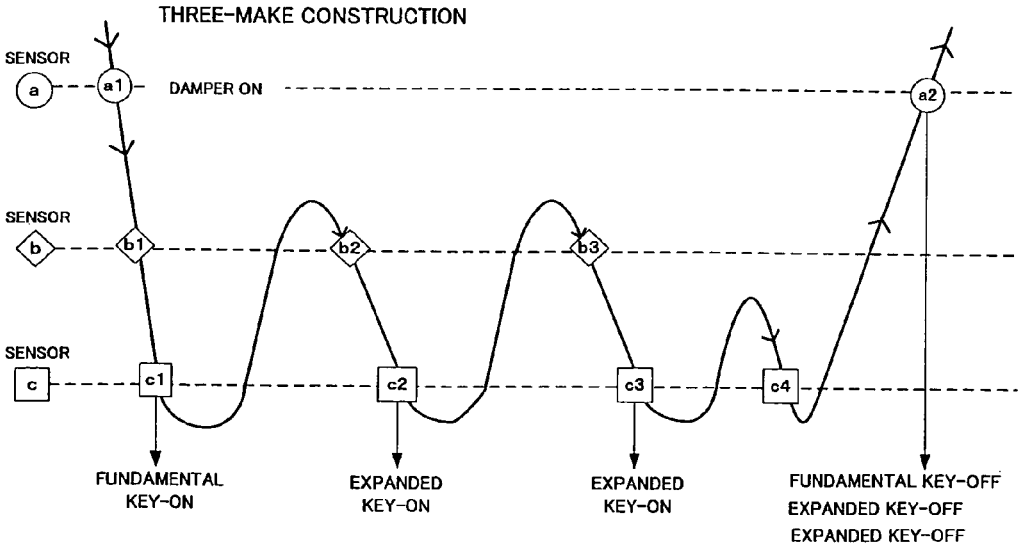

Next, a detailed example of the "tone generation control processing" will be described hereinbelow. FIGS. 4A and 4B conceptually show relationship between variation over time (temporal variation) in depressed position of a key and generated signals. More specifically, FIG. 4A shows such relationship between variation over time in depressed position of a key and generated signals in an electronic keyboard instrument of the two-make construction, while FIG. 4B shows such relationship between variation over time in depressed position of a key and generated signals in an electronic keyboard instrument of the three-make construction. Various steps to be referred to in the following description correspond to the various steps in the tone generation control processing of FIG. 2 and expanded key monitor process of FIG. 3.

First, signal generation in the electronic keyboard instrument of the two-make construction is explained with reference to FIG. 4A. Once the key passes the position of the "a" sensor (a1) in a top-to-bottom direction of the key stroke (i.e., from top down along the key stroke) due to key depressing operation by the human player, the damper is turned on and the timer counting is started (steps S2 and S3). If the key has been further depressed to the position of the "c" sensor (c1) due to continued key depressing operation, the timer counting is ceased and a fundamental key-on signal is generated (steps S7-S9), because the key has never reached the "c" sensor position (c1) and has never been brought to a key-on state before the current operation. Then, as the depression, by the human player, of the key is temporarily weakened (i.e., the key is partially released), the key gets back to a partway position between the "a" sensor position and the "c" sensor position without returning to the "a" sensor position. If, thereafter, the key has been again depressed to the position of the "c" sensor (c2), no fundamental key-on signal is generated (steps S7-S9), because, in this case, the key has reached the "c" sensor position once before the current depressing action (i.e., tone generation or key-on state is already under way for the key). Also, because the timer count value is "0" in this case (step S25), no expanded key-on signal is generated (step S28).

If the key has been depressed to the position of the "c" sensor repeatedly a plurality of times (c3 and c4) without being returned to the "a" sensor position, there takes place operations similar to those performed in response to the depression, of the key, to the "c" sensor position (c2). In each of the cases, neither fundamental key-on signal nor expanded key-on signal is generated. Then, if the depression, by the human player, of the key has been temporarily weakened (i.e., the key has been partially released) to thereby cause the key to pass the "a" sensor position (a2) in a bottom-to-top direction of the key stroke, a fundamental key-off signal is also generated at step S11.

Namely, in the electronic keyboard instrument of the two-make construction, a fundamental key-on signal is generated when a given key has passed its associated "c" sensor position during initial depression of the key. Then, no key-on/key-off signal is generated even when the key has been depressed to the "c" sensor position repeatedly a plurality of times without being returned to the "a" sensor position, but a fundamental key-off signal is generated when the key has returned to the "a" sensor position. Namely, only a pair of fundamental key-on/key-off signals are generated in response to passage of the key through the "a" sensor position. Because the time measurement by the timer counting is not newly executed when the key has got back to a partway position between the "a" sensor position and the "c" sensor position without returning to the "a" sensor position, the velocity value is kept constant. Therefore, in the electronic keyboard instrument of the two-make construction, only one tone is generated despite successive depression of the same key unless the human operator performs operation of first depressing the key to the "c" sensor position and then returning the key to the "a" sensor position.

Next, tone generation by the electronic keyboard instrument of the three-make construction will be explained with reference to FIG. 4B. When a given key has passed the position of its associated "a" sensor (a1) in the top-to-bottom direction of the key stroke (i.e., from top down along the key stroke) due to depressing operation by the human player, the damper is turned on at step S2, and the timer counting is initiated at step S3. If the given key has directly passed the position of its associated "b" sensor (b1), the timer counting is restarted from an initial zero count at step S5. Then, if the given key has been further depressed to reach the position of the associated "c" sensor (c1), a fundamental key-on signal is generated in generally the same manner as in the above-described two-make construction, at steps S7-S9. In the electronic keyboard instrument of the three-make construction, the depressed key may get back, in response to temporary weakening, by the human player, of the depressing force, to a partway position between the "a" sensor position and the "c" sensor position, without returning to the "a" sensor position, before being again depressed to the "c" sensor position (c1), in one of the following two ways. Namely, as a first possibility, the key is partially released to get back to a partway position between the "a" sensor position and the "b" sensor position and then depressed again to the "c" sensor position (c1). As a second possibility, the key is partially released to get back to a partway position between the "b" sensor position and the "c" sensor position and then depressed again to the "c" sensor position (c1).

Each time the key has been partially released to get back to a partway position between the "a" sensor position and the "b" sensor position (b2 or b3), the timer counting is restarted at step S5. Thus, in this case, a velocity value can be ultimately set which corresponds to an intensity and velocity of every depressing operation by the human player. Then, when the key has been depressed down to the "c" sensor position (c2 or c3), no fundamental key-on signal is generated at steps S7 to S9 because the key has already reached the "c" sensor position once before the current depressing operation (i.e., tone generation is already under way for the key). However, because, in this case, the current time count value is not "0" as determined at step S25, an expanded key-on signal is generated in response to each depressing operation with the timer count value cleared and the number of depressions from the "b" sensor position to the "c" sensor position (steps S26-S28). Namely, an expanded key-on signal is generated each time the key reaches the "c" sensor position (c2 or c3).

When, on the other hand, the key has been partially released to get back to a partway position between the "b" sensor position and the "c" sensor position without being returned to the "a" sensor position and then again depressed to the "c" sensor position (c4), the timer counting is not restarted at step S5. Further, no fundamental key-on signal is generated at steps S7 to S9 because tone generation (key-on event) is already under way for the key. Further, because, in this case, the current time count value is "0" as determined at step S25, no expanded key-on signal is generated at step S28. Namely, in this case, neither fundamental key-on signal nor expanded key-on signal is generated. Then, when the key has returned to and passed the "a" sensor position in the bottom-to-top direction (i.e., from bottom up along the key stroke), one or more expanded key-off signals corresponding to the counted number are generated. In this example, two expanded key-off signals are generated at step S24 because the counted number is "two". In addition, a fundamental key-off signal is also generated at step S11.

Namely, in the case of the electronic keyboard instrument of the three-make construction, a fundamental key-on signal is generated when a given key has passed the "a" sensor position during an initial key depressing action. Then, when the given key has been depressed down to the "c" sensor position after repeating its movement between the "a" sensor position and the "b" sensor position, expanded key-on/key-off signals corresponding in number to the count number of the movement between the "a" sensor position and the "b" sensor position are generated. Then, once the given key has returned to the "a" sensor position, one or more expanded key-off signals corresponding in number to the generated expanded key-on signals and a fundamental key-off signal are generated. Namely, there are generated sets of key-on/key-off signals corresponding to the number of times the given key has passed the "b" sensor position and "c" sensor position. Further, because the time measurement by the timer counting is newly performed when the key has been partially released to get back to a partway position between the "a" and "b" sensor positions without returning to the "a" sensor position, the velocity value will vary depending on a manner in which the key is re-depressed to the "c" sensor position. Therefore, in the case of the electronic keyboard instrument of the three-make construction, if the human player first depresses a given key to the "c" sensor position and then slightly weakens the depression (i.e., partially releases the key) until the key gets back to the "b" sensor position, tones can be generated as tremolo tones of a same note. Therefore, the electronic keyboard instrument of the three-make construction can provide far better operability and usability than the electronic keyboard instrument of the two-make construction, in generating tremolo tones of a same note.

In the above-described manner, the tone generation control program of the present invention permits generation of appropriate tones corresponding to operation of keys, irrespective of whether the program is applied to an electronic keyboard instrument of the two-make construction or an electronic keyboard instrument of the three-make construction. Namely, the same tone generation control program of the present invention can be shared between the electronic keyboard instruments of the two-make and three-make constructions, which can thereby eliminate a need to develop separate tone generation control programs for the two-make and three-make constructions and thus minimize the overall development cost. Further, by just prestoring the above-described tone generation control program of the invention in memory, it is possible to eliminate a need to replace the tone generation control program even when the keyboard is upgraded from the two-make construction to the three-make construction, which should prove very convenient and useful.

Where the tone generation control program of the present invention is applied to an electronic keyboard instrument having a transposition function and/or octave shift function, tone generation responsive to successive key striking of a same note, instructed after a transposition or octave shift instruction, is switched to tone generation at a transposed or octave-shifted pitch, while tone generation instructed before the transposition or octave shift instruction is performed at the pitch as before the transposition or octave shift instruction. Namely, at transposition or octave shift timing, tone generation instructed before the transposition or octave shift instruction is continued at the previous pitch without a note-off signal being generated therefore. For example, if an octave shift has been instructed from a pitch "C4" to a pitch "C5", tone generation control is performed such that tone generation at "C4" is continued without a note-off signal being generated for "C4" and tone generation at "C5" is newly started; namely, two different tone generation is effected in this case. Then, once the keyboard is released, tone generation control is performed such that note-off signals are generated for both "C4" and "C5".

According to the present invention having been described so far, the same tone generation control program can be shared between the two-make type electronic keyboard instrument and the three-make type electronic keyboard instrument, and thus it is possible to significantly reduce the cost related to the tone generation control program.

What is claimed is:

1. A computer readable medium containing a program for causing a processor to perform a method for generating tone-generation controlling key-on and key-off signals on the basis of detection signals supplied by a key operation detection device, wherein there can be applied, as said key operation detection device, either a first-type key operation detection device that, in response to depressing operation of a key, generates detection signals in correspondence with at least predetermined upper and lower positions or a second-type key operation detection device that, in response to depressing operation of a key, not only generates detection signals in correspondence with at least predetermined upper and lower positions but also generates a detection signal of an intermediate position unobtainable by said first-type key operation detection device, said method comprising:

a first step of receiving the detection signals from said key operation detection device applied;

a second step of, on the basis of the detection signals received by said first step, generating a first key-on signal when a key has reached the lower position from the upper position;

a third step of, on the basis of the received detection signals, determining whether or not particular operation has been performed for causing the key to reach the lower position from the intermediate position after generation of said first key-on signal but before generation of a key-off signal, and generating a second key-on signal if it is determined that the particular operation has been performed; and a fourth step of, on the basis of the received detection signals, generating a key-off signal in correspondence with the generated first or second key-on signal when the key has returned to a predetermined key-off position after generation of said first or second key-on signal.

2. The computer readable medium of claim 1 wherein, each time the particular operation is performed for causing the key to reach the lower position from the intermediate position after generation of said first key-on signal but before generation of the key-off signal, said third step generates said second key-on signal.

3. The computer readable medium of claim 1, wherein said predetermined key-off position corresponds to said predetermined upper position, and whereby said fourth step generates said key-off signal in correspondence with the generated first or second key-on signal when the key has returned to said predetermined upper position after generation of said first or second key-on signal.

4. The computer readable medium of claim 1, wherein said method further comprises the step of, on the basis of the received detection signals, determining key operating velocity data in accordance with either a time within which the key passes from the upper position to the lower position or a time within which the key passes from the intermediate position to the lower position.

5. A method for generating tone-generation controlling key-on and key-off signals on the basis of detection signals supplied by a key operation detection device, wherein there can be applied, as said key operation detection device, either a first-type key operation detection device that, in response to depressing operation of a key, generates detection signals in correspondence with at least predetermined upper and lower positions or a second-type key operation detection device that, in response to depressing operation of a key, not only generates detection signals in correspondence with at least predetermined upper and lower positions but also generates a detection signal of an intermediate position unobtainable by said first-type key operation detection device, said method comprising:

a first step of receiving the detection signals from said key operation detection device applied;

a second step of, on the basis of the detection signals received by said first step, generating a first key-on signal when a key has reached the lower position from the upper position;

a third step of, on the basis of the received detection signals, determining whether or not particular operation has been performed for causing the key to reach the lower position from the intermediate position after generation of said first key-on signal but before generation of a key-off signal, and generating a second key-on signal if it is determined that the particular operation has been performed; and a fourth step of, on the basis of the received detection signals, generating a key-off signal in correspondence with the generated first or second key-on signal when the key has returned to a predetermined key-off position after generation of said first or second key-on signal.

6. An electronic keyboard instrument comprising:

a keyboard having a plurality of keys;

a key operation detection device that detects depressing operation for each of the keys on said keyboard, wherein said key operation detection device is of either a first type that, in response to depressing operation of the key, generates detection signals in correspondence with at least predetermined upper and lower positions or a second type that, in response to depressing operation of the key, not only generates detection signals in correspondence with at least predetermined upper and lower positions but also generates a detection signal of an intermediate position unobtainable by said first type; and processor means having installed therein the program recited in claim 1 and coupled with said key operation detection device, said processor means executing said program to generate key-on and key-off signals in response to operation of any one of the keys on said keyboard.

7. An electronic keyboard instrument comprising:

a keyboard having a plurality of keys;

a key operation detection device that detects depressing operation for each of the keys on said keyboard, wherein said key operation detection device is of either a first type that, in response to depressing operation of the key, generates detection signals in correspondence with at least predetermined upper and lower positions or a second type that, in response to depressing operation of the key, not only generates detection signals in correspondence with at least predetermined upper and lower positions but also generates a detection signal of an intermediate position unobtainable by said first type; and a processor coupled with said key operation detection device and adapted to;

on the basis of the detection signals received from said key operation detection device, generate a first key-on signal when the key has reached the lower position from the upper position;

on the basis of the detection signals received from said key operation detection device, determine whether or not particular operation has been performed for causing the key to reach the lower position from the intermediate position after generation of said first key-on signal but before generation of a key-off signal, and generating a second key-on signal if it is determined that the particular operation has been performed;

on the basis of the detection signals received from said key operation detection device, generate a key-off signal in correspondence with the generated first or second key-on signal when the key has returned to a predetermined key-off position after generation of said first or second key-on signal; and control tone generation in accordance with the generated key-on or key-off signal.

* * * * *